United States Patent [19]

Oetiker et al.

[11] 4,442,980

[45] Apr. 17, 1984

[54] PROCEDURE AND MECHANISM FOR THE AUTOMATIC CONTROL OF A GRINDING MILL ROLLER CARRIAGE EQUIPPED WITH A REGULATED PRODUCT FEED

[75] Inventors: Hans Oetiker, St. Gallen; Robert Linzberger, Abtwil; Leendert Ketting, Oberuzwil; Werner Winteler, Oberhelfenschwil, all of Switzerland

[73] Assignee: Bebruder Buhler AG., Unzwil, Switzerland

[21] Appl. No.: 321,165

[22] PCT Filed: Dec. 5, 1980

[86] PCT No.: PCT/CH80/00151

§ 371 Date: Nov. 9, 1981

§ 102(e) Date: Nov. 9, 1981

[30] Foreign Application Priority Data

Apr. 11, 1980 [CH] Switzerland ..... 2796/80

[51] Int. Cl.[3] ..... B02C 25/00

[52] U.S. Cl. ..... 241/34; 241/143; 241/235

[58] Field of Search ..... 241/33, 34, 36, 37, 241/30, 235, 236, 63, 64, 143, 144

[56] References Cited

U.S. PATENT DOCUMENTS

| | | | |
|---|---|---|---|
| 3,468,488 | 9/1969 | Karrer et al. | 241/34 |
| 3,618,865 | 11/1971 | Grundler | 241/34 X |

FOREIGN PATENT DOCUMENTS

| | | | |
|---|---|---|---|
| 582423 | 8/1933 | Fed. Rep. of Germany . | |
| 286841 | 3/1953 | Switzerland . | |
| 306619 | 7/1955 | Switzerland . | |
| 418791 | 2/1967 | Switzerland . | |
| 698085 | 10/1953 | United Kingdom | 241/37 |

*Primary Examiner*—Mark Rosenbaum

*Attorney, Agent, or Firm*—Darby & Darby

[57] ABSTRACT

The invention describes a new type of automation for a roller carriage. The amount of product conveyed to the roller carriage is constantly subject to fluctuations, and is determined by a mechanical probe. A corresponding signal directly activates a pneumatic valve, and control pressure adjusts the instantaneous performance of the grinding rolls. The pneumatic valve has a so-called zero position, and becomes a follower control device by means of servo-media and the adjusting mechanism of the performance-dependent elements in the roller carriage. At the same time, the control pressure in the pneumatic valve can start and stop the grinding rolls.

7 Claims, 8 Drawing Figures

110

Figure 8:
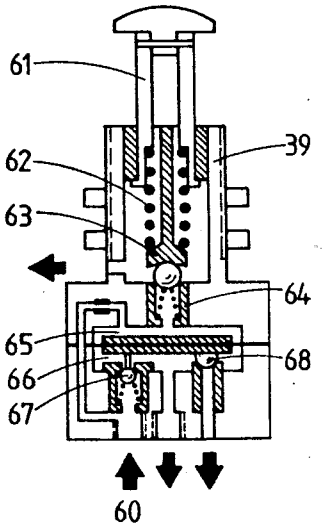

81
113
114
111
112
98
115
1',2'
1,2
116
118
120
121
99
97
95
Wa.1, Wa.2....
Wa.1, Wa.2....
96

PROCEDURE AND MECHANISM FOR THE AUTOMATIC CONTROL OF A GRINDING MILL ROLLER CARRIAGE EQUIPPED WITH A REGULATED PRODUCT FEED

The invention refers to a procedure for the automatic control of a grinding mill roller carriage, equipped with a regulated product feed, which generates a mechanical signal for the control of a metering slide on the product feed, which is dependent thereon. The invention further refers to an automatically controlled grinding mill roller carriage which is equipped with a regulated product feed, for the performance of such a procedure, which has a metering slide for the supply of the product, as well as a connected mechanical signaller, activated by the supply of the product.

The mill grinding, or respectively the production of bread, flour, semolina, steam etc., is the exception in the grinding technique. Because the qualitative requirements for the roller carriage, as well as for its control, are very high, comparative to paint roller mills and others. When paint is ground in paste form, the product is stored above two feed rollers so that the rollers can always draw the same quantity of the product.

The supply of the rolling mill is dependent on the product level in the reservoir. In contrast, the grinding mill roller carriage is part of a completely automatic grinding and straining process. The preparation for grinding occurs over one or two lines, which are then conveyed to one to four, or more raw material passages. The resultant first grit is then split up into several fractions in the plan sifter, from where fractions can be removed as finished products of the grinding process. The remaining fractions are continuously fed into further grinding and sifting operations. The so called 'posterior grinding passages' receive individual fall-off from several plan sifters.

Depending on the raw material condition, the grinding preparation and environmental influences, (such as humidity, temperature, etc.), the yield of flour varies from short to large batches from each plan sifter. Short-term interference factors must also be considered, such as accelerated or retarded sliding of the product down inclined planes, etc. The effect of the individual interference factors can become additive, (in a negative sense), or they can equalize. With equal mixtures, fluctuations in performance are mostly under ten percent of the average. However, they may at times be in the range of ten to thirty percent, and this upper limit may go over fifty percent deviation from the average value, with extreme changes in the mixture. When no material to be ground is fed, the posterior grit passages as well as the smoothing rolls must be separated, because of the danger of running the grinding rolls up on each other and the accompanying danger of destruction, due to the high speed turning and full pressure.

The task of a regulated product feed in a grinding mill roller carriage is not to assure a constant feed, because each roller carriage is a link in the whole process chain, and must be capable of fully accepting and processing quantities of the product. The main target of such a regulated product feed is the manufacture of an even product curtain over the full length of the grinding rolls.

Two basic functions apply to the automatic operation of grinding mill roller carriages. They are one: the regulation of the feed, and two: the automatic starting and stopping of a grinding roll. A number of propositions have been made for both functions, whereby the regulation of the feed as well as the automatic starting and stopping of the grinding rolls is dependent on the product feed and must be controlled by a respectively acting feeler element.

CH-PS No. 418 791 describes a grinding mill roller carriage with performance-dependent elements which are controlled by a central, electro-capacitive feed measuring device, which determines if sufficient product is stored in the feed above a feed roll, and which produces the respective electrical control signals for the electro-pneumatic valves that control the starting and stopping of grinding rolls on the one hand, and the regulation of the metering slide on the other. However, on especially difficult products, it has been shown that the regulation of the feed is not always appropriate, because some of the product can stick to the capacitive probe and thus make fine adjustments difficult.

The problems do not occur in the mechanical regulation of milling material feeds in grinding mill roller carriages, as possibly described in CH-PS No. 306 619 or 286 814. In those cases, the quantity of the product is determined by a probe hanging inside the product flow, and is mechanically transmitted by a lever arm directly to the metering slide. Appropriate springs assure that this metering segment is tensioned towards its closed position. On such a control, the regulating force of the control links must be directly produced by the product flow, which excludes such a control, since the required control forces are relatively large (possibly also to start and stop the grinding roll).

The DE-PS No. 582 423 describes a combination of electrical and mechanical controls, suitable for large control forces. However, their construction cost is very considerable because of the combined mechanical and electrical system.

Hydraulic controls have also been tried. They produce large forces from relatively small hydraulic cylinders, thus permitting the use of mechanical impulse transmitters. The required switching power for the servo control can be very small, and the construction of the probe can remain simple. This small switching power has the advantage of the probes presenting low resistance to the product flow, and can therefore be built as self-cleaning units. However, there is the danger, under unfavorable conditions, of oil contaminating the grinding process, for example the flour. Furthermore, the construction cost for such hydraulic devices is great and they require constantly increasing maintenance. There have been isolated cases where problems were caused by changes in the viscosity of the oil being used.

After considering the various systems, the disadvantage of the mechanical controls is their high construction cost and questionable automation (especially important for remote-control activation). The advantage, on the other hand, is easily understood adjustments, even by less qualified operators. Purely hydraulic controls have the advantage of reliability as well as the need for low signalling forces. However, they are coupled with extraordinarily high construction costs, require the use of a foreign material as their operating medium (oil), and the prerequisite of a hydraulic pump working constantly against the required hydraulic pressure, causing a certain specific loss of energy. Purely pneumatic solutions could only be used until now in single control functions, such as the starting and stopping of grinding rolls. A useable adjustment control, such as for the feed for example, is not known, because the corresponding attempts only resulted in unsteady controls and undesirable loads on the grinding rolls. Purely electrical systems are costly to produce, especially when taking into consideration the required explosion-proofing today. However, they are easily remote-controlled.

Starting from the state of the present day techniques, the invention has the task to improve the above mentioned kind, (mechanical signaller activated by the product flow) in such a manner, as to be utilized for control operations requiring a large amount of force, but with simple construction and at low cost, and still be reliable in its function and operation.

This task has been solved by a mechanical control signal which is first changed into a pneumatic control signal, and then is used as the input signal to a servo control for the regulation of the product feed and/or a servo control for the start and stopping of a grinding roll; in other words being used as the control signal for a pneumatic servo drive for the control of performance-dependent elements of the grinding roll.

The invention offers not only a surprisingly simple solution, but still has almost all of the advantages of the former single systems, shown earlier. According to the invention, a mechanical control signal first is changed into a pneumatic control signal, which is then conveyed via pneumatic servo devices to the performance-dependent elements of the grinding roll. The servo devices then produce the required adjustment forces and accomplish the necessary control functions.

Another advantage of the invention is that the mechanical control signal is changed into a digital pneumatic signal. Furthermore, the pneumatic control signal in this invention allows the adjustment of the contact pressure between the grinding rolls.

A further advantage of the invention is that each change in the mechanical control signal is immediately changed into an analogous pneumatic signal, but the changed pneumatic signal is then time-dependently returned in the direction of the original value before the change occurred. This process is naturally interrupted and restarted as soon as another change in the mechanical signal is detected. This permits attaining a time-delayed lag of the zero point in the change of the pneumatic control signal which produces faborable conditions for the adjustment of a balanced point from where a new control impulse can start, when used with appropriate pneumatic servomotors for the activation of the performance-dependent elements (metering slide, start and stop of the grinding roll). This adjustment of a balanced point finally results in very stable feed to the grinding rolls.

Another advantage is that the pneumatic control signal is returned gradually (digitally) in the direction of the starting value, which permits diverting a superimposed, partly digital, partly analog pneumatic signal from the mechanical signaller of the feed control. Preferably the digital element can be used for a direct regulation function, while the analog portion is used to maintain a centain balanced position.

When achieving a stable balance, even with short-term interference, it is an advantage that the change in the mechanical signal only causes a change in the pneumatic signal after a predetermined (short) time-delay. This insures that recurring, but short-lived changes in the product feed do not provoke a change in the control procedure.

In contrast to earlier known procedures, the invention permits achievement of a relatively constant product flow and also a constant level of production, but beyond this, it somewhat smoothes out strong fluctuations in performance by means of the product feed adjustments. Short-term, sudden loads in the product feed are passed along in delayed form, due to the elasticity of the system, even if temporary delays are not directly considered in the conversion. During application of the lag (regulation of the zero point), the system is first rough adjusted. Then the fine adjustment is attained with the constant effect of the analog control signal, which has been changed into a pneumatic signal.

The automatically controlled, product feed equipped grinding mill roller carriage in the invention, which uses the procedure in the invention, is equipped with a metering slide for the product flow, as well as with a connected, mechanical signaller which is activated by the product flow. In the invention, the mechanical signaller activates a pneumatic control valve, the output of which is connected to the input of a servo mechanism for the regulation of the metering slide and/or the starting and stopping of the grinding roll. The pneumatic control valve is so connected to the servo mechanism, that it lags behind every movement of the signal link, which is an advantage. This permits attainment of an especially simple, effective and advantageous development, in that the pneumatic control valve can be switched, by means of a link, to an on and off position and, between the on and off position, to a zero position. In this configuration it can remain in either of the three.

Another advantageous development in the grinding mill roller carriage is that the servo mechanism contains a pneumatic cylinder with a piston and piston rod, which is connected to the roller carriage housing on one end, and on the other the piston rod is directly connected to the adjustment links for the metering slide, respectively for the starting and stopping of the grinding roll. The piston rod is activated on one side by the feed force (preferably constant), which can be either feed air pressure or spring pressure, and on the other side by the control pressure (output pressure) of the pneumatic valve, in such a manner that in the zero position of the valve, the pressure air from the control side is locked in, and the latest pressure is maintained. This configuration, where the servo mechanism acts on the adjustments of the performance-dependent elements of the grinding roll, is the result of the control mechanism together with the signaller of the feed control signal, which form a kind of closed, mechanical/-pneumatic balance-and-tare system.

It has further proven to be of great value if the grinding mill roller carriage in the invention is provided with a lever arm, linked on one end to the frame of the roller carriage, and its free end is connected to the housing of the pneumatic valve and then directly attached to the piston rod of the servo mechanism, preferably also to links for the regulation of the metering slide (metering gap) and/or the RPM of the feed roll. In this configuration the servo mechanism forms a unit with the lever arm connected on one side to the roller carriage, whereby the signaller of the feed control signal controls the pneumatic valve at the extreme end of the lever arm, and the pneumatic cylinder attaches directly to the lever arm. The invention permits adjustment of the feed by regulating the metering slide and/or changing the feed roll RPM. Thus, a type of grinding mill roller carriage was achieved, with a product feed that could be operated alternatively or simultaneously with the metering slide on the one hand, and the feed roll RPM on the other. It showed good operability at a surprisingly low construction cost. It was demonstrated that floury or gritty products could give optimum results by adjustment of the metering slide. However, in other cases, for instance when a greater portion was bran, (as during the first passages), a simple adjustment of the metering slide was not satisfactory. In such cases the roller carriage in the invention now offers the capability to exert a sufficiently large force on the servo mechanism, in a very simple manner, and also for the regulation of the feed roll RPM.

The control signal, which is transformed into a pneumatic signal, can now be used to advantage to control the starting and stopping of the grinding rolls, by activating a second valve with the control pressure of the pneumatic valve, which also controls the starting and stopping of the grinding rolls. At the same time, the control pressure of the second valve could possibly be used to indicate the starting and stopping of the grinding rolls optically.

A further advantageous development in the grinding mill roller carriage in this invention is also that the pneumatic control valve is a diaphragm valve, which is activated by a push rod or roller lever with a ventilating hole.

The construction of the roller carriage in the invention is surprisingly simple. Tests under practical conditions have shown that the roller carriage in the invention solves the task posed by the invention with operational reliability and in an excellent manner. In a test case in which the product performance of the roller carriage was uniform, it was shown that the product level in the feed storage above the metering roll also remained constant. In another test case, with extreme performance fluctuations, the configuration in the invention was shown to be best for the control of the performance fluctuations and at the same time achieve good compensation. The use of the pneumatic control valve at the end of a lever arm that pivots from the grinding roll housing (as described earlier), gave almost optimum results because of the built-in lag between the mechanical signal and the pneumatic valve operation, from the viewpoint of desired operational reliability and construction costs.

Figure 1:
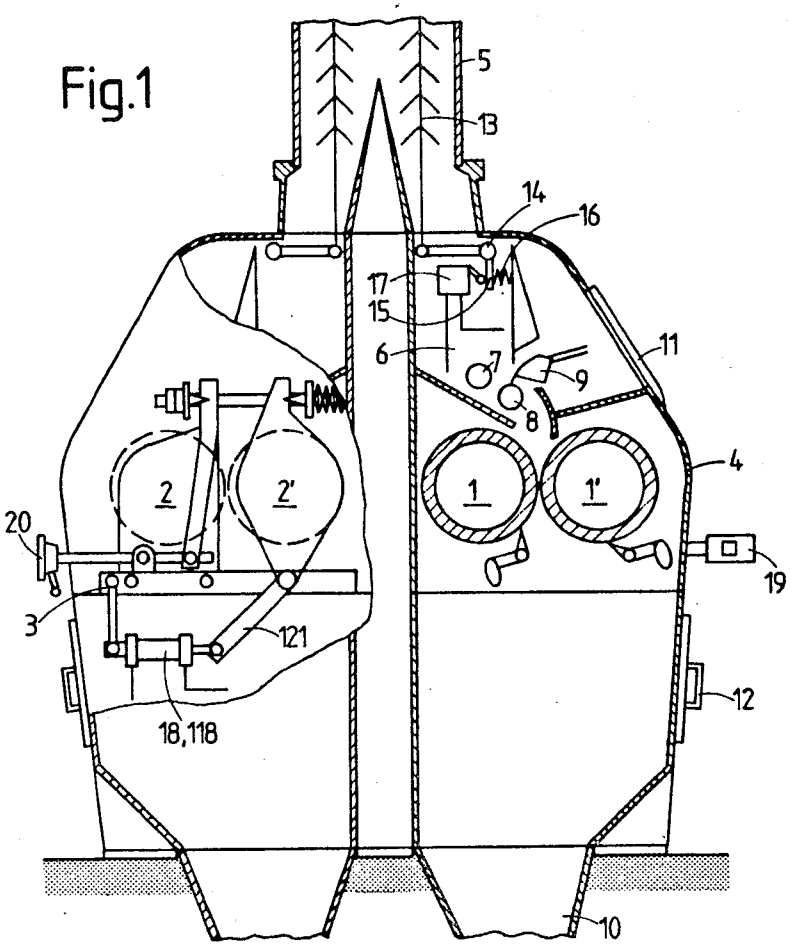

The following, together with the drawings, will further detail the principle of the invention:

FIG. 1 schematic representation of the grinding mill roller carriage in the invention, partially in sectional view.

Figure 2:
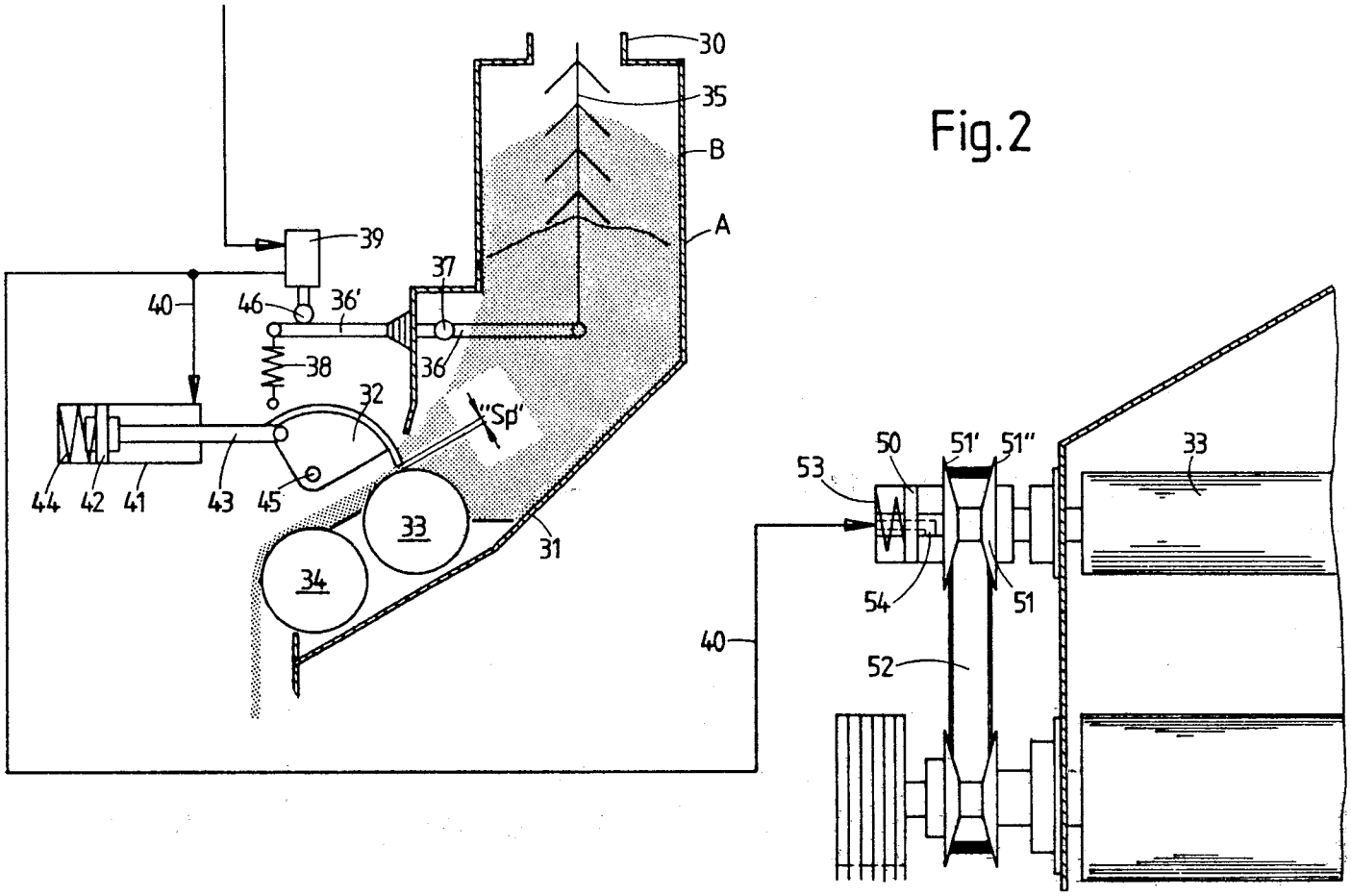

FIG. 2 example of the construction of the feed regulation in the invention.

Figure 3:
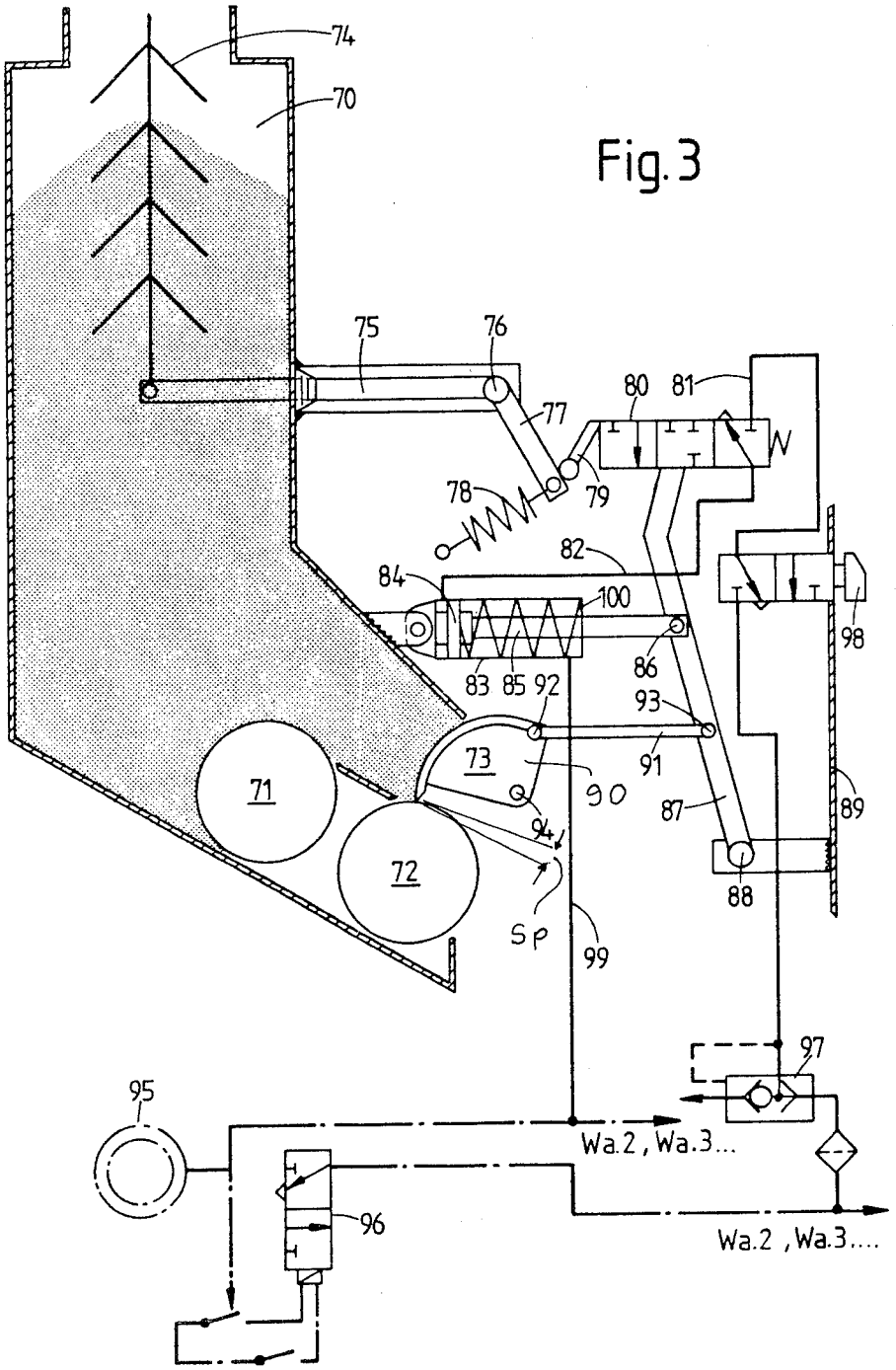

FIG. 3 another example of the same.

Figure 4:
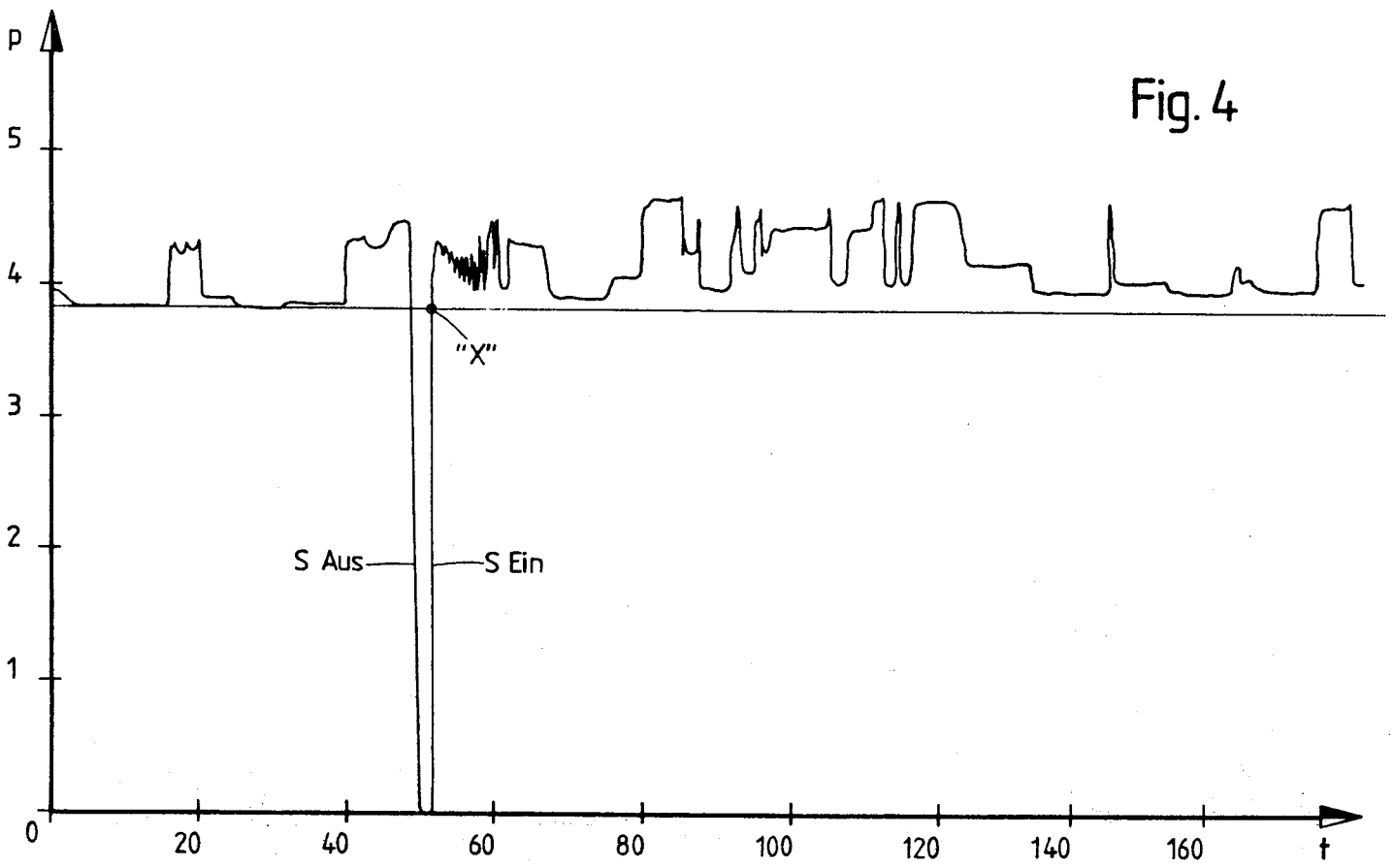
Figure 5:
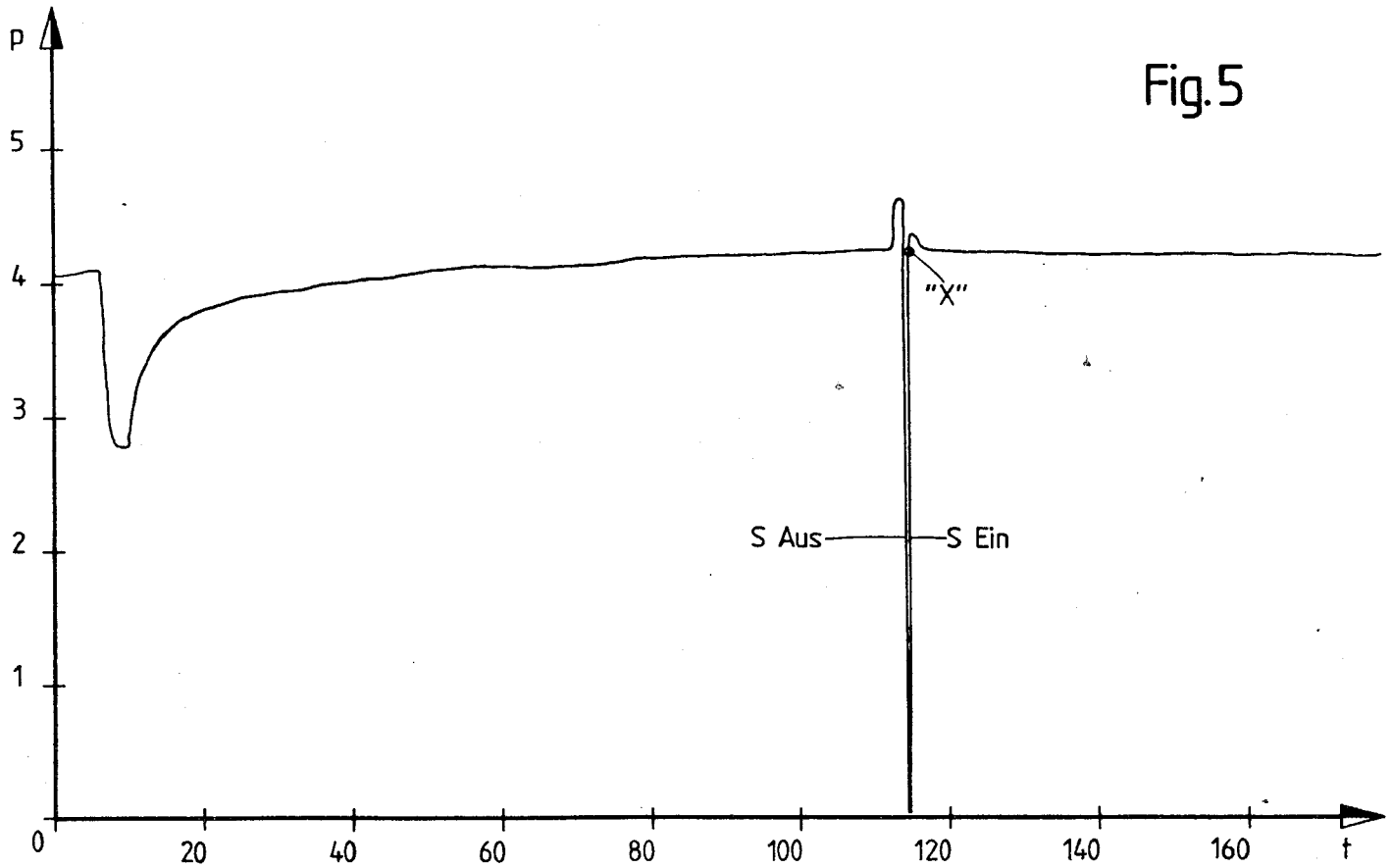

FIG. 4 and FIG. 5 measured pressure distribution of a pneumatic control signal to a configuration as in FIG. 3.

Figure 6:
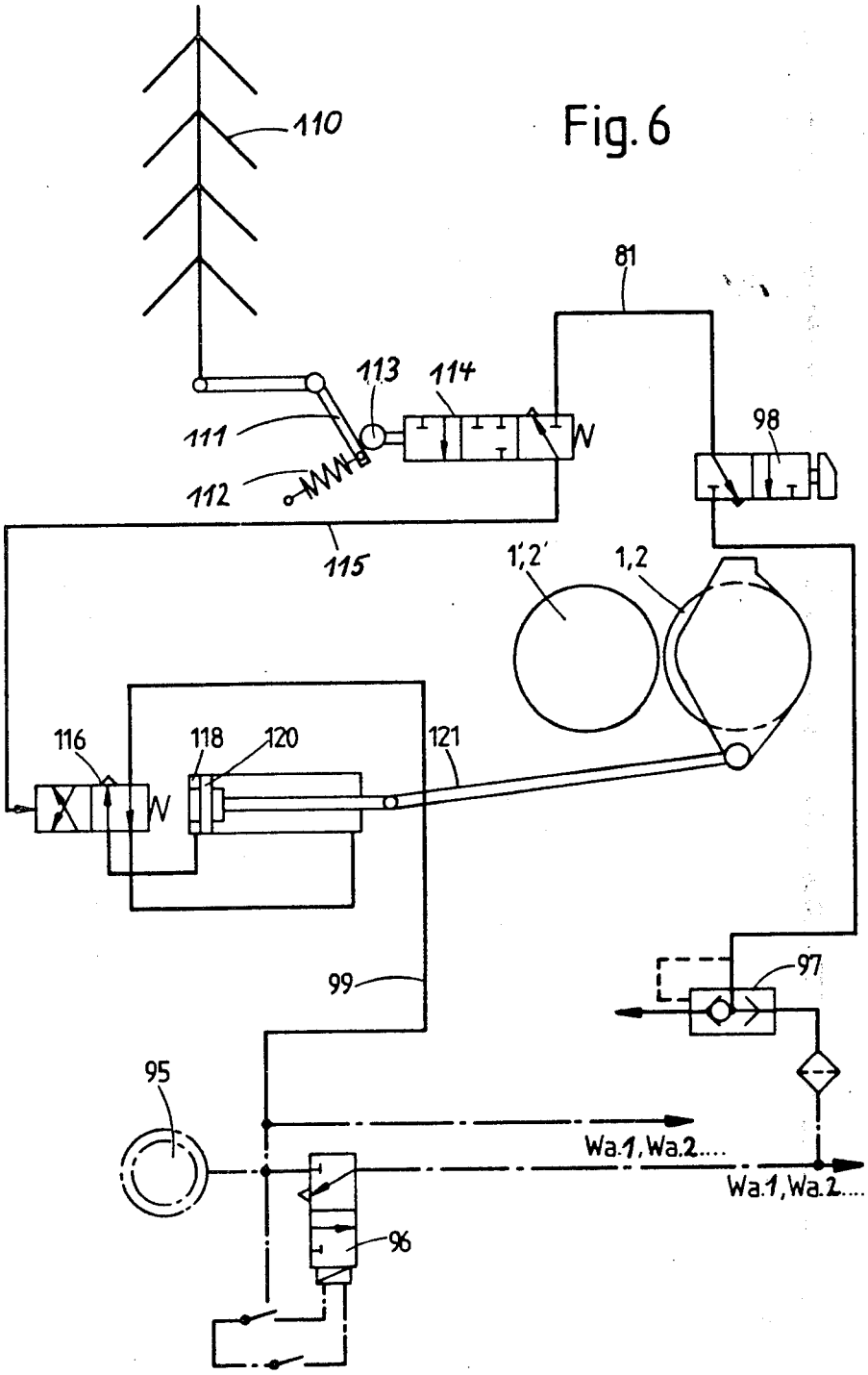

FIG. 6 Configuration of a roller carriage in the invention with automatic starting and stopping of the rolls.

Figure 7:
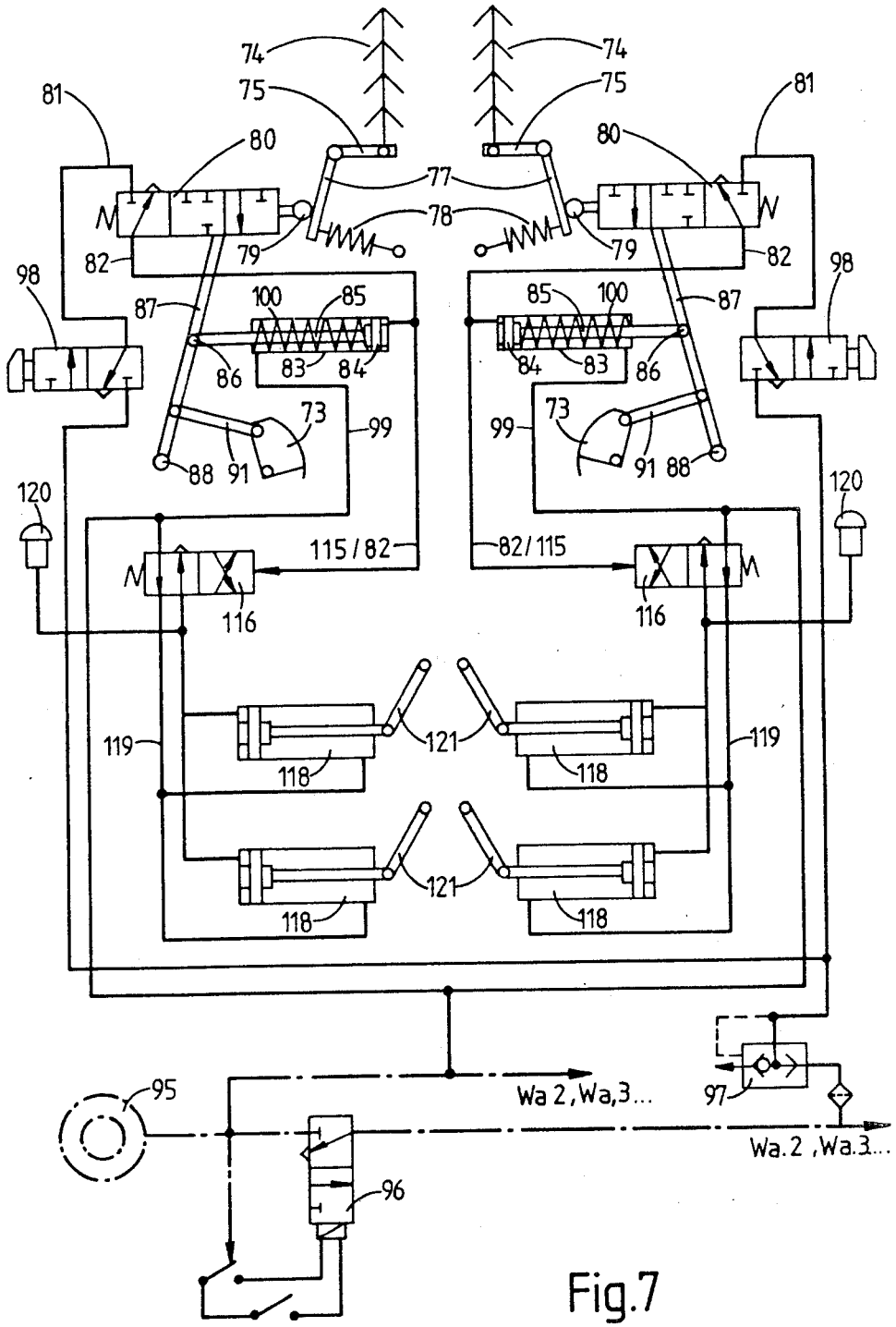

FIG. 7 a complete control diagram for a roller carriage in the invention, with feed regulation combined with automatic starting and stopping of the rolls.

FIG. 8 section of a pneumatic valve for changing the mechanical control signal into a pneumatic control signal.

FIG. 1 shows a double configuration of a grinding mill roller carriage, i.e. with two pairs of grinding rolls 1, 1', and 2, 2', with the grinding rolls placed lengthwise in a frame, and the whole roller carriage closed to the outside by a case 4. The material to be ground is conveyed to a feed cylinder 5, usually made of Plexiglas, to an extended feed storage 6, with a distribution coil 7 and a feed roll 8 at the lower end. This feed roll, together with the metering slide 9, form the mechanical part of a metering unit. Under the grinding rolls 1, 1', 2, 2', is a hopper 10 for ground material. The case 4 also contains a service door 11 for the feed side of the grinding rolls 1, 1', 2, 2', as well as a control door 12 through which the quality and condition of the ground product can be monitored. A probe is installed in or above the feed storage 6, which can move a signaller 15 through an axle 14. The movement of the signaller 15 is influenced by the quantity of the product on the one hand, and also by the kinetic energy of the flowing product mass and a return spring 16, on the other. Since the distance-to-force relationship of the return spring is adjustable, or predetermined, the signaller 15 produces a mechanical signal analogous to the product feed (as on a mechanical balance). The signaller 15 is in direct contact with a pneumatic valve 17, respectively with the push rod and roller lever in this valve. The mechanical signal of signaller 15 is transformed into a pneumatic control signal in the pneumatic valve 17, whereby the air pressure in the pneumatic valve 17 is transformed in the pneumatic valve into a pressure control signal analogous to the production feed. This signal, called "feed control signal", is the output signal for the control and regulation of single, (or preferably several) performance-dependent elements in the roller carriage. The feed control signal can also be used for the actual control of the feed as well as for the adjustment of the feed roll RPM 8, or the adjustment of the metering gap by adjusting the metering slide 9. It can furthermore be used at the same time for the automatic control of the starting and stopping of the grinding rolls with cylinder 18, and also for indicating the roll position. In addition the feed control signal can be used to adjust the grinding rolls by means of an automatic regulation device 19. This regulation device can be combined with a manual adjustment wheel or, in case of further automation, with a corresponding computer activated remote-control, as described in CH-PS No. 418 791.

From this can be seen that the control signal can be used as a pressure signal for each signal function, especially in view of a combination of several control and regulation functions or operating conditions. In the forefront is the combined control of the feed, and the starting and stopping of the rolls, which can be achieved through the common pneumatic/mechanical servo circuit.

FIG. 2 shows the individual components in the feed control in schematic form. The left side of the picture shows the area of the feed storage on the grinding mill roller carriage as in FIG. 1, in sectional view, while the right side shows the correlation of the feed roll to the grinding rolls schematically.

The material to be ground runs into the feed storage 31 through a glass cylinder 30, which is closed on the bottom by a metering slide 32 and a feed roll 33. There is a metering gap (Sp) between the feed roll 33 and the metering slide 32. After feed roll 33 is a distribution roll 34 which insures even distribution of the products over the full length of the rolls. The feed storage 31 contains a probe 35, which is attached to a pivoting carrier 36 by means of a corresponding balance arm. This carrier, together with the probe 35, can exert a tipping motion around axle 37, against a tension spring 38 which works against the weight and impulse of the grinding material and loads the carrier 36 in a clockwise direction. Depending on the arrangement of the tension spring and the lever distance of the carrier, as well as the compression of the spring, the performance-dependent play of the probe can be predetermined. In the sense of FIG. 1, here too a mechanically produced control signal acts on the arm 36' of carrier 36, (shown left in the fig.), as signaller for a pneumatic valve 39, which can be built as shown in FIG. 8. The pneumatic valve 39 transforms the mechanical control signal into an analogous pneumatic pressure signal, which acts on one side of pneumatic cylinder 41 as control or pressure force by means of control line 40. The piston 42 and piston rod 43 in pneumatic cylinder 41 are acted upon on one side by a compression spring, and on the other side by the pressure according to the analog control signal of the pneumatic valve 39. The piston rod 43 is connected to the metering slide 32, so that the latter can be moved by the piston rod 43, through pivot 45 and thereby adjust the metering gap "Sp". The named elements, especially the pneumatic valve 39, the pneumatic cylinder 42 as the servo mechanism and the metering slide 32 on the one hand, as well as the grinding material-to-probe force effect on the other, form a closed servo-feed-control circuit which needs no other energy than air pressure.

The device functions as follows: If, for example, the product level in feed storage 31 under the probe is at "A", no force is exerted by the material to be ground on probe 35. Spring 38 draws arm 36' and the mechanical signaller downward, the pushrod 46 of the pneumatic valve 39 is unloaded and the control line 40 is not pressurized. The spring pressure pushes the metering control 32 toward the feed roll against a stop (not shown), so that the metering gap "Sp" is at, or near zero. When material to be ground is conveyed to the roller carriage through the glass cylinder 30, it exerts a weight-impulse force on the probe 35. The signaller forces the push rod 46 upward, in proportion to the product being introduced. This builds a corresponding pressure signal in the pneumatic valve 39, which in turn increases the metering gap "Sp" by means of the servo cylinder 41. The metering slide 32 is opened, or moved until a balance between the quantity of material in the feed storage 31 and the metered quantity being drawn off below, has been achieved. At this point the feed storage probe rod remains constant.

As can be seen in the right half of FIG. 2, the control line 40 branches off directly to a second servo cylinder 50, attached to the axle of a variodisk 51. The feed roll is turned by one of the grinding rolls 1, 1', 2, 2', which are driven by a main motor (not shown), by means of a vario-belt drive. When the control line 40 contains no pressure, a spring 53 pushes the one movable half 51 of the belt-disk against the fixed half 51''. This reduces the distance between the two disk halves and pushes the wedge-shaped drive-belt outwards. At the same time the feed roll RPM is reduced, because the effective diameter of the driven belt-disk is increased. If the pressure increases in control line 40, it acts on the opposite side of the servo cylinder through corresponding bore holes and reduces the force of spring 53, increasing the distance between the two halves of the belt-disks and reducing the drive circle of the belt. This automatically increases the RPM of the feed roll in proportion to the increase of the metering gap "Sp". The pneumatic valve 39 acts principally, as shown in the enlarged scale in FIG. 8, as a distance-to-pressure converter: a displacement is translated into an analogous pneumatic signal. The operation develops as follows:

When the push rod moves in, the spring 62 is compressed, the spring shoe 63 presses the ball into the seat of the servo nozzle, which increases the pressure 60 in chamber 65 in proportion to the force of the spring or its distance. The diaphragm of the power amplifier is pushed down and opens the ball valve 67 until the pressure in chamber 66 has equalized. Upon release of spring 62, the servo nozzle is opened 64, and the pressure in chamber 65 is reduced. This permits the diaphragm in chamber 65 to be pushed up by the pressure in chamber 66 and the ball valve 68 opens.

FIG. 3 shows the product feed control in schematic form: The left side shows the feed storage 70 which is closed off at the bottom by a distribution roll 71, a feed roll 72 as well as a metering slide 73. The feed storage 70 contains a probe 74 which is supprted by a carrier 75 on a pivot pin 76. The carrier 75 has a signaller 77, connected on one side to a spring 78 and on the other side to roller lever 79 of the pneumatic valve 80. The inlet side of pneumatic valve 80 is connected to the pressure line 81. A control line 82 connects the pneumatic valve 80 with servo cylinder 83 to pressurize one side of the piston 84 located inside. There is also a piston rod 85, one end of which is connected to a lever arm 87 by means of a joint pin 86. The lever arm 87 in turn is attached to the fixed frame structure 89 by a swivel joint 88. The pneumatic valve is attached to the other end of lever arm 87 and therefore follows the movement of the piston rod 85 and lever arm 87 in accordance with the principles of leverage. Lever arm 87 is also attached to the metering slide 90 by a connecting link 91 and locked to pins 92 and 93. The metering slide 90 tilts around a pivot bearing 94 which, depending on its momentary position, produces a metering gap "Sp" between it and feed roll 72. The whole system is operated by pressure supply 95.

The air pressure for the control side can also be interrupted by manual switch 98 for servicing. Pressure in the system is maintained by the above supply at a constant (for example at a rate of 6 bars) and is carried by line 99 as counterpressure to the opposite side of the control pressure on piston 84. A spring 100 alone, or in conjunction with the above mentioned constant pressure in line 99 can also be used. This has the advantage of securing the metering slide in a closed position, should the air pressure fail.

FIG. 4 shows the pressure distribution of the control signal, as can be verified in control line 82 by a manograph. The values correspond to measurements on the B passage of a roller carriage. During the first phase of about 50 seconds, the pressure is noticeably stable and was only momentarily interrupted (at 29 seconds) by a brief rise in pressure. The mostly horizontal line of the curve shows that short-term fluctuations in the control signal are not carried over. At about 50 seconds, the control circuit was manually interrupted by cutting out the grinding rolls 1, 1', at which time the control signal immediately dropped to zero. This quick response to a corresponding interference by the control is very advantageous. Starting of the control function after switching on the grinding rolls is very important. The control signal coasts for about 1 second, as measured by the manograph. The signal resumes almost immediately at a medium value, which is especially interesting from a technical control point of view. It then oscillates around this value for about 10 seconds and returns at once to a stable control action. The quick reaction to change, which occurs almost without any overmodulation and without resonant rise, is especially remarkable.

FIG. 4 shows constantly returning control periods of 5 to 10 seconds, which are all within a relatively narrow range of adjustment. This is very important for the grinding rolls and roller bearings, because oscillation of the resonance rise can be avoided with constantly changing grinding forces in the feed control mechanism.

FIG. 5 shows the control signal during a C passage (i.e. one of the later passages), during which the amount of the product in the roller carriage does not vary over longer and shorter periods. This case is easily attainable with control technique. About 5 seconds after the start of measurment, the product flow was briefly disturbed, which caused a corresponding reduction in the control signal. The curve that followed can be viewed as a nearly ideal one, from the automatic control point of view. Here too, the grinding rolls were manually turned off and immediately on again, at about 115 seconds. The diagram shows surprisingly that, after this interruption, the original control signal value is obtained after about 1 to 2 seconds, without any overshoot The example illustrated by FIG. 6, is similar to the embodiment of FIG. 3; the FIG. 6 embodiment has a signaller 111 activated by a probe 110. A spring 112 acts on the signaller 111, which disconnects it from the switching contact 113 of the pneumatic valve 114, in case no product is being conveyed to the roller carriage. A control line 115 runs from this pneumatic valve 114 to a repeater valve 116. The pneumatic valve 114 transforms the mechanical control signal from the signaller 111 into a pneumatic pressure signal. The pneumatic control signal is formed in proportion to the feed reaching the probe 110. The repeater valve 116 is so adjusted, that it releases the full system pressure (for ex. 6 bar), from pressure line 117 to control line 115 and into pneumatic cylinder 118, upon a predetermined pressure from the pneumatic control signal. If the adjusted increase value of the pressure signal has not reached the repeater valve 116, the left surface of the movable piston 120 in pneumatic cylinder 118 remains without pressure. The right side however, receives the full system pressure, and the piston 120 remains in the disengaged position. Once the pressure in control line 115 exceeds the adjusted value of for example 2 bar, the full system pressure is directed to the left piston surface, and the piston translates. Then all of the rolls, $Wa_2$, $Wa_3$ . . . can be turned off by means of the quick ventilator 97 in the central control valve 96.

Piston 120 is coupled to the movable roll 1, 2 by a piston rod 121 to the corresponding roller bearing, so that the described movement from the control signal can be directly used to start and stop the grinding rolls. The air pressure supply in the model shown in FIG. 6 can be the same as in FIG. 3, (coinciding parts have been indentified with equal numbers).

The control function for the product feed is very different from the starting and stopping function of the grinding rolls. Control of the feed should be gentle, whereas the starting and stopping of grinding rolls should occur suddenly (however, without clashing of the rolls).

FIGS. 4 and 5 show points "S-off" and "S-on" for the switching adjustment of valve 116, at a 2-bar pressure level for starting and stopping the grinding rolls. The switching point for valve 116 was consciously chosen to be essentially under the normal operating range of the feed. The representations in FIGS. 4 and 5 clearly show in their curves how the stopping, and especially the starting of the grinding rolls occurs simultaneously almost with the opening of the metering slide, (Compare curves "X"). Both functions are accomplished in one passage. If the grinding rolls were started before any product had been fed to them, they would run the risk of clashing against each other. This could have deleterious effects.

FIG. 7 shows a configuration which essentially combines the feed control in FIG. 3 with the starting and stopping of grinding rolls in FIG. 6. According to the model in FIG. 1, FIG. 7 represents a typical grinding mill roller carriage with double configuration for the actual grinding unit. In addition it also shows that the servo cylinder for starting and stopping the grinding rolls, is actually four, one at each end.

The operation of a grinding mill roller carriage, as shown in the examples in FIGS. 1 through 7, is the following:

The grinding gap between rolls 1, 1', 2, 2', is adjusted by a manual wheel in accordance with the material to be ground. A draw spring 16 or 78 lifts the probe 13 or 74 up, when no grinding material is being fed to cylinder 5. The signaller 15 or 77 does not contact the switch 79 of the pneumatic valve 17 or 80, and no pressure is formed in control line 82. The spring 100 or pressure in line 99 (or both, depending on selection of system) push lever arm 87 counterclockwise, and thus metering slide 9 or 73 in a closed position. The metering gap "Sp" is closed and no product is being conveyed to grinding rolls 1, 1', 2, 2'. The lack of a control signal in line 82 or 115 makes the control valve 116 idle and this disconnects grinding rolls 1, 1', 2, 2' from cylinder 118.

When material to be ground is fed by feed roll 5 to the roller carriage, the force of the flowing product or a corresponding component of its weight acts on probe 13 or 74, which is pushed down. Signaller 77 moves to the right, pushes the switching contact 79 and starts the control signal.

Pressure is now forming in control line 82, but at first does not cause any change in the signal. However, as soon as the pressure reaches a set value, the grinding rolls are started (as per FIG. 6). This is a dynamic process. Probe 13 or 74 is moving with signaller 15 or 77 which pushes switching contact 79 fully against the pneumatic valve 17 or 80, in one move. The use of a very sensitive diaphragm valve 80 will assure that the smallest movement by signaller 15 or 77 causes the maximum release of control pressure in line 82. The result is that piston rod 85, lever 87 as well as pneumatic valve 80 are activated in a period of hundredths or tenths of a second, and the directly connected metering slide begins to open and product is dispensed onto the grinding rolls. Both cylinder 118 and cylinder 83 are built as pneumatic servo cylinders, which produce quick, but not sudden working forces. In contact to hydraulic media, the air in the cylinder acts as a type of "shock absorber". It was shown that appropriate selection of the draw and compression springs in sections of the pneumatic lines, as well as adequate initial tension of the springs, was instrumental in attaining a synchronous running of the control and adjustment functions of the various machine elements. This holds true for the inlet as well as the outlet case.

The following operations are shown in FIGS. 3 and 7: Lever arm 87, upon introduction of some product, at first makes a small move in a clockwise direction. At the same time, switching contact 79 moves away from signaller 77. Draw spring 78 is tensioned in proportion to the distance of signaller 77. If only a small amount of product is fed to the glass cylinder, the product forces on probe 13 or 74 are quickly balanced, and feed segment 73, lever arm 87 and the pneumatic valve remain in their positions. At the same time however, signaller 77 and switching contact 79, which can be pushed by a spring into the pneumatic valve 80, are constantly working against each other. This causes very small movements which have no influence however on the transformed pneumatic control signal. This is of great advantage. The pneumatic valve remains during this phase in a so-called zero position, where all inlets and outlets are closed. This retains the pressure formed during the first phase in the pneumatic valve, and piston 84 remains rigidly fixed in its position, due to the stable, and relatively large forces of the pressure relationship on both sides of the piston. The metering slide remains motionless in its position. If the product feed is increased by cylinder 5, or if for another reason the amount in the feed storage is larger than what can draw off through the metering gap, signaller 15 or 77 moves further in the direction of the switching contact 79 and the pneumatic valve 89. The latter follows the signaller and produces a corresponding control signal with a higher pressure in line 82, due to the set value. Depending on the situation, for example even with a starting procedure or similar, a pneumatic control signal as shown in FIG. 4 or 5 is formed or started. As can be seen in FIG. 5, depending on the condition, a stable balance can be achieved with a uniform signal pattern. However, even with constantly fluctuating feed performance, individual periods of stability are apparent, during which the pneumatic valve can be in any position of the lever arm 87, and alternate with the zero position. The adjustment shown is then able to produce a very uniform control signal (compare FIG. 5), or, during very variable feed performance, produce a signal with repeated stable phases, (compare FIG. 4).

As can be seen in FIG. 7, the control pressure in line 119 can be used to optically indicate the position of the rolls. For example a colored indicator inside glass viewer 120 could be moved with air pressure to indicate the starting and stopping of grinding rolls in either red or green. As can further be seen in FIG. 1, the pneumatic control signal can be used in line 82 to set the grinding rolls independently of the performance. Thus the grinding gap for increasing the metering could be held constant by increasing the grinding pressure, or could be increased or decreased. The respective grinding gap control mechanism 19 could be a direct pneumatic cylinder or another appropriate mechanical or electrical medium, connected to a remote control (perhaps a computer or processing calculator), which produces a basic value for the respective grinding task, which would correspond to the momentary performance of the roller carriage, independently of the pneumatic control signal. It is understood that other configurations or function can also be introduced, such as for example with respect to threshold, safety circuits, etc. It is especially of advantage that the pressure between grinding rolls can be adjusted by the pneumatic control signal, depending on the feed performance. It is further remarkable that the pneumatic control signal can adjust the feed as well as control the starting and stopping of the grinding rolls, at the same time.

We claim:

1. In an improved system for use in a grinding mill for automatically controlling an operating condition controllable between first and second states, said system including position adjustable regulating means for regulating the operating condition; a fluid operated servomechanism operatively connected to said regulating means for adjusting its position and having an inlet and outlet; sensing means responsive to the operating condition for positioning an indicating portion of said sensing means in dependence upon said operating condition; valve means interposed between said servomechanism and a source of compressed fluid for controlling the supply of fluid thereto, said valve means including actuator means operatively connected to said indicating portion and responsive to the position thereof for moving between a first position and a second position as said operating condition varies between said first and second states; valve inlet means for connection to said source, and a valve outlet connected to said servomechanism inlet; the improvement comprising:

said valve means having means responsive to the first position of said actuator means for producing a first operational mode wherein said valve inlet is blocked and said valve outlet is vented, means responsive to a position of said actuator intermediate said first and second positions for producing a second operational mode wherein both said valve inlet and outlet are blocked, and means responsive to the second position of said actuator for producing a third mode of operation wherein said valve inlet and outlet are connected with each other; and means for mechanically coupling said valve means to the regulating means so that a change of the regulating means position causes a corresponding movement of the valve relative to said indicating portion in a direction tending to urge said actuator to said intermediate position.

2. In a grinding mill, an arrangement for automatically controlling the rate of product output from a storage housing in the grinding mill, comprising:

a product feed incorporating position adjustable metering slide means for regulating the rate of product output;

a servomechanism operatively connected to said metering slide means for adjusting its position and having an inlet and outlet;

mechanical link means, within said housing, responsive to the rate of product feed for positioning a portion of said link in dependence upon said feed rate;

valve means including actuator arm means operatively connected to the mechanical link means portion and responsive to the position thereof for moving from a first position to a second position with increasing product feed, valve inlet means for connection to a source of compressed air, a valve outlet connected to said servomechanism inlet, said valve means having means responsive to the first position of said actuator to produce a first operational mode wherein said valve inlet is blocked and said valve outlet is vented, means responsive to a position of said actuator intermediate said first and second positions to produce a second operational mode wherein both said valve inlet and outlet are blocked, and means responsive to the second position of said actuator to produce a third mode of operation wherein said valve inlet and outlet are connected with each other; and means for mechanically coupling said valve means to the metering slide means so that a change of the metering slide position causes a corresponding movement of the valve relative to said mechanical link means portion in a direction tending to urge said actuator to said intermediate position.

3. Arrangement according to claim 2, wherein said valve means includes means for delaying the response of the actuator to the mechanical link for a predetermined time period.

4. Arrangement according to claim 2 for use in a grinding mill having controllable grinding rollers, wherein said valve outlet is further connected with a pneumatic reversing valve for actuating the grinding rollers.

5. Arrangement according to claim 2, further comprising:

a lever arm is provided having one end fixed with respect to said storage housing, and a free end affixed to the valve means;

the servomechanism including a pneumatic cylinder having a piston and a piston rod, said cylinder being fixed with respect to said storage housing;

said piston rod being connected to said lever arm;

said cyliner including a second inlet for connection to a pressure source; and connecting links for the adjustment of the metering slide affixed to the lever arm.

6. Arrangement according to claim 5, wherein the piston is biased by a compression spring towards a closed position of the metering slide.

7. Arrangement according to claim 2, wherein the pneumatic valve is a membrane valve with a pestle or a roller lever as a switch.

* * * * *